United States Patent [19]

Dengler

[11] 4,143,782

[45] Mar. 13, 1979

[54] ROTARY DEVICE FOR FORK-LIFT TRUCKS

[76] Inventor: Paul E. Dengler, 10946 Kane Ave., Whittier, Calif. 90604

[21] Appl. No.: 832,659

[22] Filed: Sep. 12, 1977

[51] Int. Cl.[2] ..... B66F 9/19

[52] U.S. Cl. ..... 414/672; 414/620

[58] Field of Search ..... 214/701 Q, 652, 660, 214/701 R, 141, 138 R, 768

[56] References Cited

U.S. PATENT DOCUMENTS

| | | | |
|---|---|---|---|
| 2,623,654 | 12/1952 | Dunham | 214/701 Q |
| 2,635,774 | 4/1953 | Backofen et al. | 214/652 |
| 2,870,929 | 1/1959 | Quayle | 214/652 |
| 3,191,788 | 6/1965 | Hopfeld | 214/652 X |
| 3,738,519 | 6/1973 | Edwards | 214/652 |

*Primary Examiner*—Albert J. Makay

[57] ABSTRACT

A rotary device adapted for use with fork-lift trucks, wherein the fork members thereof are mounted to the rotary device and arranged in a normal pick-up position so as to engage a conventional trash container, whereby the container is lifted and rotated about the axis of the device, thereby dumping the trash disposed in the container. The rotary device comprises a rear mounting plate adapted to be secured to the lifting structure of the fork-lift. The plate includes a bearing spindle attached thereto on which a bearing hub is rotatably mounted; and the bearing hub includes a locking drum which is releasably positioned by a locking assembly mounted to one side thereof. Secured to the free end of the bearing hub is a fork-mounting plate whereby the fork members are adapted to be supported thereon, so as to rotate with the bearing hub. When the locking assembly is released, the container will automatically rotate for dumping; and, when the forks are lowered, the container may be easily returned to the normal upright position.

1 Claim, 6 Drawing Figures

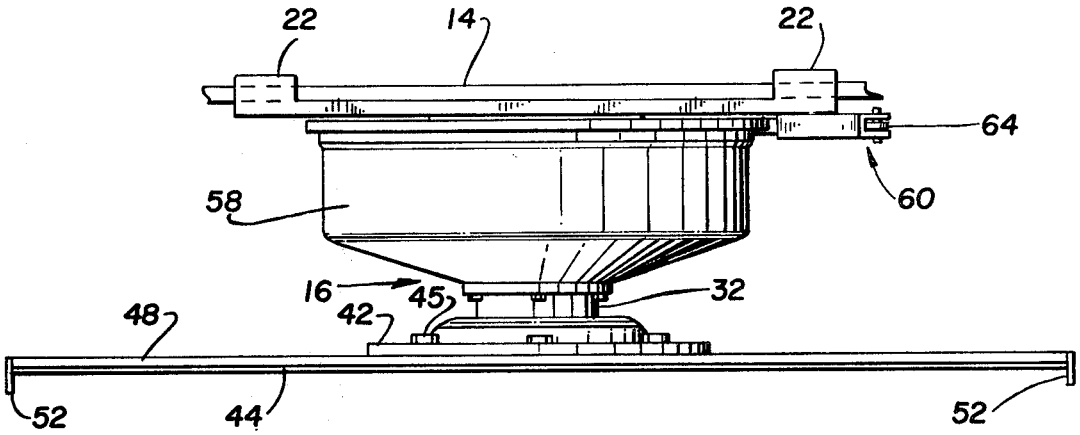
FIG. 5
FIG. 6
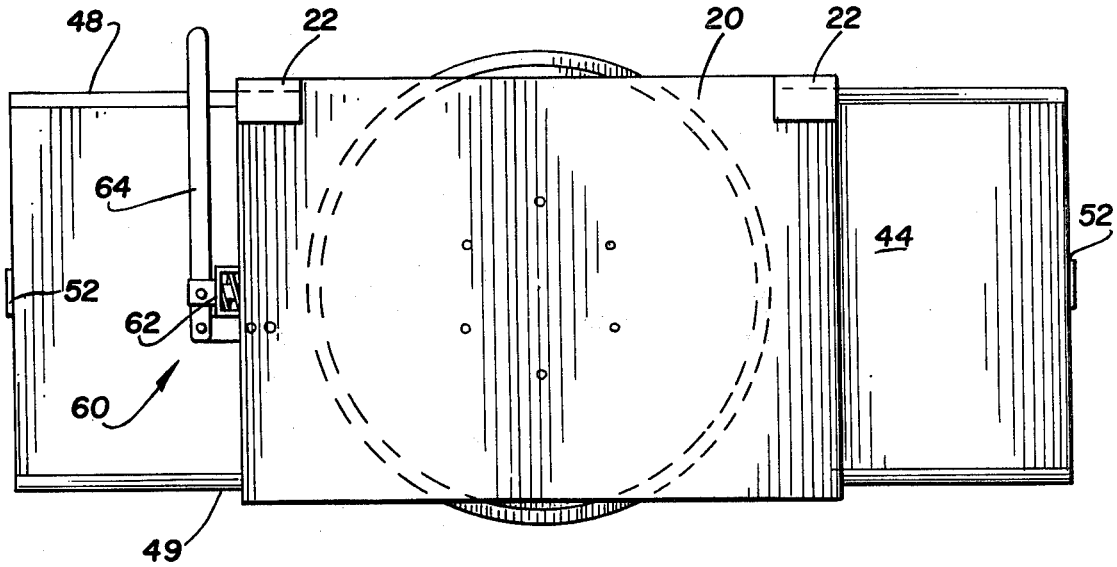

ROTARY DEVICE FOR FORK-LIFT TRUCKS

BACKGROUND OF THE INVENTION

1. Field of the Invention

This invention relates to fork-lift trucks and, more particularly, to a rotary attachment device that is rotatably mounted to the fork-lift truck, to allow the fork members to be secured to the device for rotation about a central axis.

2. Description of the Prior Art

As is well known in the art, various problems and difficulties are encountered in providing suitable means for dumping trash from large commercial trash containers. Generally, these containers must be raised and dumped by fork-lift devices — particularly those devices used with fork-lift trucks, which are well known in the industry.

The various devices that are generally known for this purpose have not been considered completely satisfactory. In addition, most rotary devices presently available do not lend themselves to the problem of dumping trash from a large container in a simple and easy operation. Some of the known rotating units are disclosed in U.S. Pat. Nos. 2,468,32, 3,024,929, 3,876,100, 2,979,217 and 2,623,654.

SUMMARY OF THE INVENTION

The invention resides in a means for rotating fork members associated with fork-lift vehicles, particularly the well-known, conventional, fork-lift trucks, wherein a pair of fork members are mounted thereon to lift various articles of equipment. The present invention comprises a rotary device which is secured to the lifting structure of a fork-lift truck by a rear-mounting plate which is provided with a centrally positioned bearing spindle, the bearing spindle being adapted to rotatably support a bearing hub which includes an annular locking drum. The hub is formed with an annular flange member to which is affixed a fork-mounting plate, whereby a pair of conventional fork members are removably secured. Thus, the fork members will rotate about the central axis of the rotary device when a locking mechanism is disengaged from the locking drum.

When a trash container is lifted by the fork members, the center of gravity is above the spindle; and, when the locking mechanism is released, the container will rotate on its own — thereby dumping the load of trash disposed therein. The container is readily righted with little effort as the forks are once again lowered to a normal position.

OBJECTS AND ADVANTAGES OF THE INVENTION

It is an important object of the present invention to provide a simple yet unique rotary means for attachment to a conventional fork-lift truck, whereby the fork members can be readily rotated about a central axis — particularly when the fork members have engaged and are supporting a large trash container that must be inverted so as to dump the trash disposed therein.

Another object of the invention is to provide a rotary device for fork-lift trucks that includes a locking release system that can be operated under any load force applied to the device.

It is still another object of the invention to provide a device of this character that has relatively few moving parts, so as to allow a long working life thereto.

It is a further object of the invention to provide a mechanism of this type for fork-lift vehicles wherein the position of the center of gravity is such that, when the locking means is released, the container will — with little or no effort on the part of the operator — rotate on the axis of the spindle.

A still further object of the invention is to provide a device of this character that is relatively inexpensive to manufacture.

Still another object of the invention is to provide a device of this type that is simple and rugged construction — yet easy to service and maintain.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only:

FIG. 5 is a top-plan view of the rotary device; and

FIG. 6 is a rear-plan view thereof.

DESCRIPTION OF THE PREFERRED EMBODIMENT

Figure 1:
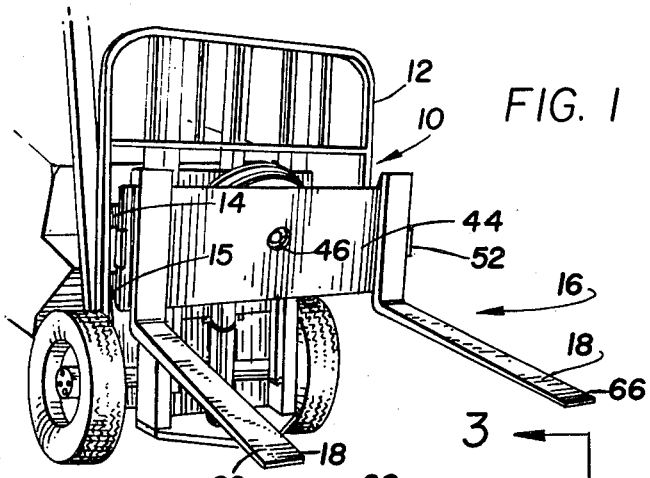
FIG. 1 is a pictorial perspective view of a portion of a fork-lift truck having the present invention attached thereto and the fork members mounted thereon.

Referring more particularly to FIG. 1, there is shown a portion of a fork-lift truck, generally indicated at 10, having a fork-lift structure 12 which is adapted to move llinearly in an up-and-down movement, as is well known in the art thereof.

Structure 12 also includes a plurality of transverse support bars 14 and 15 to which the present invention is secured thereto, the invention being a rotary device, indicated generally at 16. A pair of fork-lift members 18 are shown mounted to the front of the device 16, whereby the rotary device and the fork members are moved in a vertical plane when lift structure 12 is actuated. Thus, the vertical lift is established by the lift structure 12; and the rotating movement of the fork members is provided by the present rotary device 16.

Accordingly, the rotary device comprises a rear support plate 20 having a pair of hook members 22 formed thereon, as seen in FIG. 6. These hook members are positioned at each upper corner of plate 20.

Figure 3:
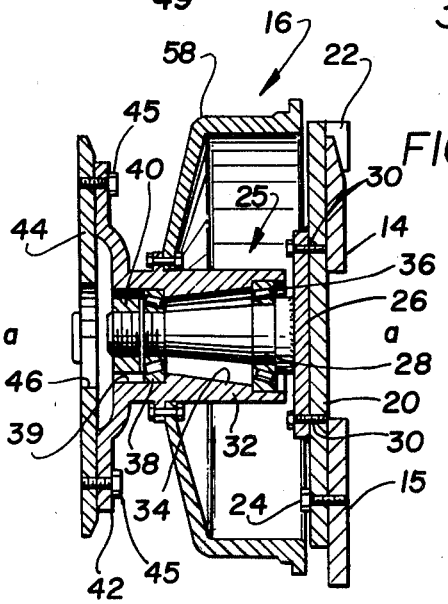
FIG. 3 is a cross-sectional view taken substantially along line 3—3 of FIG. 2.
Figure 4:
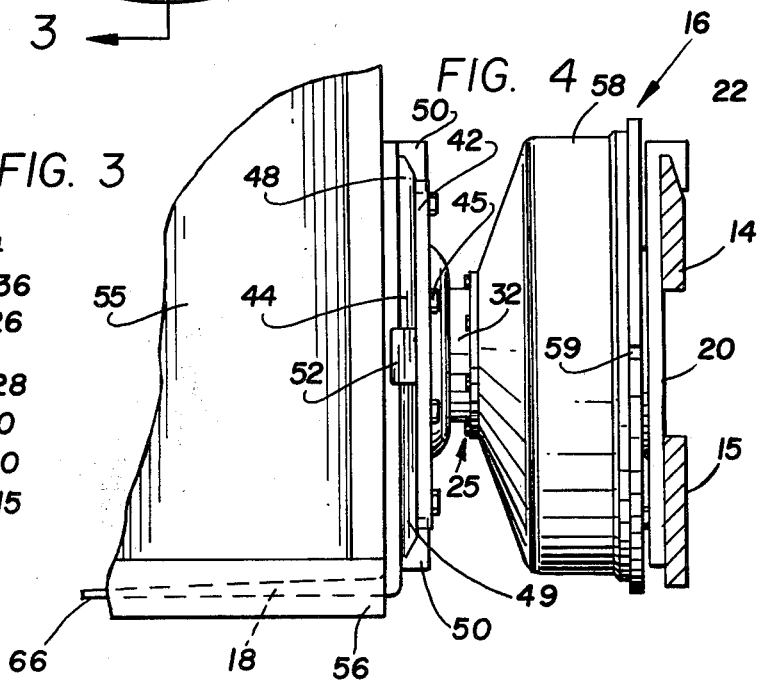
FIG. 4 is a side-elevational view of the present invention shown mounted to the fork-lift structure, wherein a trash container is supported by the fork members.

Support plate 20 is thus adapted to be mounted to the transverse bar members 14 and 15, whereby hook members 22 are arranged to receive the upper bar member 14 therein, as seen in FIGS. 3 and 4.

In FIG. 3, plate 20 is also shown secured to the lower bar member 15 by bolts 24; however, it should be understood that other suitable fastening means can be employed, such as welding plate 20 to bars 14 and 15 when a permanent installation is required.

Affixed to support plate 20 and extending laterally outwardly therefrom is a spindle means, indicated generally at 25, which is secured to plate 20 by a base plate 26, welded or otherwise affixed to spindle 28. Here again, bolt fasteners 30 are used to secure the spindle means to support plate 20 — and yet, if required, welding can be substituted therefor.

Rotatably mounted to spindle 28 is a hub member 32 having a pair of bearing means interposed between the spindle 28 and the bore 34 of the hub 32. The bearing means comprises a rear bearing 36 and a front bearing 38, wherein bearing 38 is received in an enlarged bore portion 39. This allows spindle means 25 to be rotatably fastened to spindle 28 by nut 40 which is threadably received by the free threaded end of spindle 28, as seen in FIG. 3 of the drawings.

Hub member 32 also includes an enlarged radial flange 42 to which the fork-mounting plate 44 is affixed by bolts 45. Plate 44 is generally an elongated rectangular sheet of metal having a central hole 46, said hole being an access opening to nut 40. The upper and lower longitudinal edges 48 and 49 of mounting plates 44 are beveled to receive keeper means 50 formed on each fork member 18, whereby said fork members are readily mounted to plate 44.

In addition, mounting plate 44 includes end stop means, such as stop tabs 52 attached at each end thereof to prevent fork members 18 from separating from said plate 44 due to the lateral movement as the device is rotated about the central axis a-a of the spindle means 16, as shown in FIG. 3.

When fork members 18 are mounted to mounting plate 44, rotational movement is prevented to allow forks 18 to engage with a trash container 55 in a normal manner, wherein forks 18 enter corresponding receiving members 56 (seen in FIG. 4).

Figure 2:
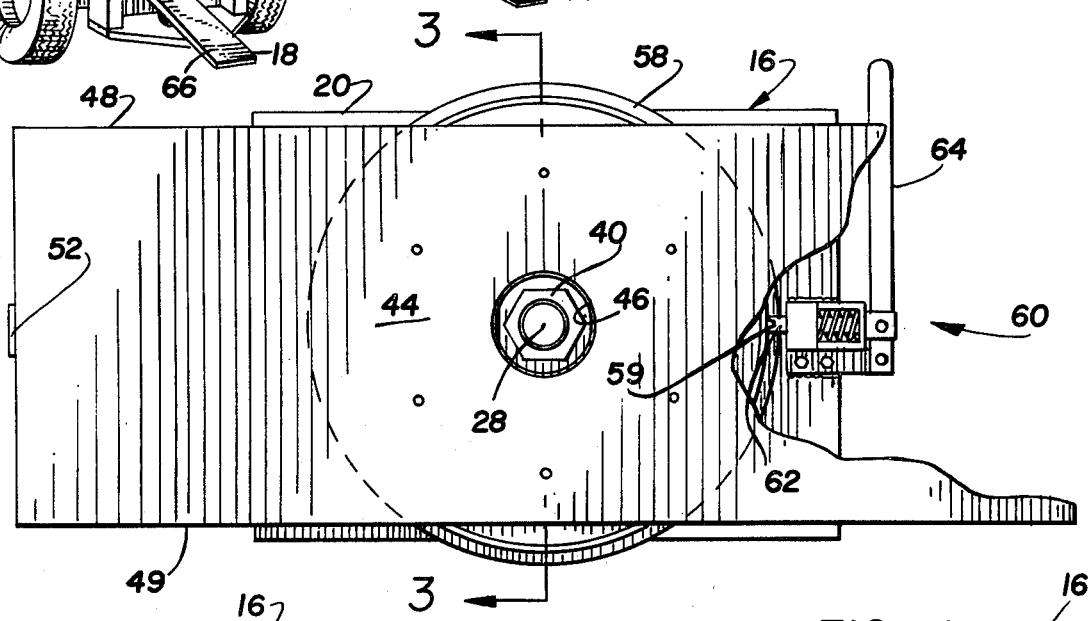
FIG. 2 is an enlarged, front-plan view of the device with a portion thereof broken away to show the locking means mounted thereto.

Thus, there is provided a locking means comprising a locking drum 58 which is mounted and fastened to hub 32 which also forms part of the spindle means 16. Drum 58 includes a slot or locking groove 59 in which a latching means, generally indicated at 60, is releasably engaged therein. Said latching means 60 comprises a latching pin 62 which is spring biased to be normally latched into slot 59, as shown in FIG. 2. Pin 62 is pivotally connected to lever arm 64; and, thus, when rotation of the device is required, lever arm 64 is pulled, thus releasing pin 62 from groove 59 — at which time the over-center weight of the trash filled container 55 will automatically cause rotation about the spindle axis a—a, allowing the container to be inverted and dumping out its contents.

After the container is emptied, it is returned to its normal upright position by rotating the container 55 to a point where the extended blades 66 are substantially parallel to ground level, and then brought downwardly to engage the ground level — thus forcing the entire unit and container back to a normal locked position wherein the fork can be disengaged from the empty container.

The invention and its attendant advantages will be understood from the foregoing description; and it will be apparent that various changes may be made in the form, construction and arangement of the parts of the invention without departing from the spirit and scope thereof or sacrificing its material advantages, the arrangement hereinbefore described being merely by way of example; and I do not wish to be restricted to the specific form shown or uses mentioned, except as defined in the accompanying claims.

I claim:

1. A rotary device adapted for use in combination with a fork-lift truck, wherein the device comprises:

a rear-support plate mountably secured to the lifting structure of said fork lift, and having a pair of hook members formed thereon and positioned to engage the lifting structure of said fork lift;

a bearing spindle secured to said rear-support plate and including:

a base plate suitably affixed to said rear-support plate;

a spindle member mounted to said base plate and extending outwardly therefrom;

a hub member rotatably supported on said spindle having an enlarged annular flange member;

bearing means interposed between said spindle and said hub member;

a fork-mounting plate attached to said annular flange member of said bearing spindle so as to rotate about the central axis of said bearing spindle;

a locking drum mounted to said hub member and disposed between said annular flange and said rear support plate, whereby said drum rotates with said hub member, said drum having a locking slot disposed therein;

latching means operably affixed to said rear support plate and arranged to releasably engage said slot of said drum;

a pair of oppositely disposed fork-lift members removably mounted to said fork-mounting plate; and a pair of stop tabs attached to each end of said fork mounting plate to prevent lateral movement of said fork-lift members as said fork-lift members rotate about the central axis of said spindle.

* * * * *